United States Patent [19]

Cliff

[11] Patent Number: 4,946,051

[45] Date of Patent: Aug. 7, 1990

[54] TWO-BOOM CRAWLER CRANE

[76] Inventor: John O. Cliff, 211 Deerfield La., Franklin, Tenn. 37064

[21] Appl. No.: 333,264

[22] Filed: Apr. 5, 1989

[51] Int. Cl.[5] ..... B66C 23/26

[52] U.S. Cl. ..... 212/258; 212/261; 212/264

[58] Field of Search ..... 212/180, 181, 186, 258, 212/260, 261, 262, 267, 268, 264

[56] References Cited

U.S. PATENT DOCUMENTS

| | | | |
|---|---|---|---|
| 2,413,529 | 12/1946 | Swaney | 212/258 |
| 2,698,096 | 12/1954 | Hughes | 212/267 |
| 2,733,818 | 2/1956 | Gregersen | 212/261 |
| 4,666,049 | 5/1987 | Gilmore | 212/258 |

FOREIGN PATENT DOCUMENTS

| | | | |
|---|---|---|---|
| 2046851 | 3/1971 | France | 212/268 |
| 62851 | 5/1977 | Japan | 212/261 |
| 703490 | 12/1979 | U.S.S.R. | 212/258 |
| 751789 | 7/1980 | U.S.S.R. | 212/258 |
| 1036668 | 8/1983 | U.S.S.R. | 212/258 |

*Primary Examiner*—Sherman D. Basinger
*Assistant Examiner*—Thomas J. Brahan
*Attorney, Agent, or Firm*—Abe Hatcher

[57] ABSTRACT

A crawler crane made up of a crane frame and body on tracks, a telescoping boom projecting from the body, a fixed-length A-frame boom with rotatable arms, a mechanism for lifting the telescoping boom and a device for extending the telescoping boom.

5 Claims, 1 Drawing Sheet

TWO-BOOM CRAWLER CRANE

BACKGROUND OF THE INVENTION

1. Field of the Invention

This invention relates to crawler cranes. More particularly, it relates to a crawler crane which has two booms.

2. Description of the Prior Art

A crawler crane is a crane on tracks. A standard crawler crane has a single boom which extends from the main body of the crane. A modified form has only an A-frame boom attached to the side frame of the crane at two points along one of its two tracks. Each of these crawler cranes has a seriously limited lifting capacity.

SUMMARY OF THE INVENTION

After extended investigation I have found that I can surprisingly increase structural and weight-lifting capacity of a crawler crane by employing a fixed-length A-frame boom supported by a variable-length, preferably telescoping boom. The arms of the A-frame, which may have, for example, one or two or more cross members running therebetween, are pinned together where they are joined to the top end of the variable-length boom in such a manner that the A-frame boom may be turned or swivelled in a circular manner. The variable-length boom is powered by at least one external cylinder or internal hydraulic means. Both may be employed if properly synchronized. A winch is employed to pick up and move heavy objects. An auxiliary winch may be used to move the variable-length boom in and out.

BRIEF DESCRIPTION OF THE DRAWING

For a better understanding of my invention, reference to the drawing and to a preferred embodiment of the invention will now be made.

The drawing, identified as FIG. 1, is a perspective view of a representative two-boom crawler crane according to the invention, including alternative parts.

DETAILED DESCRIPTION OF THE INVENTION

Figure 1:
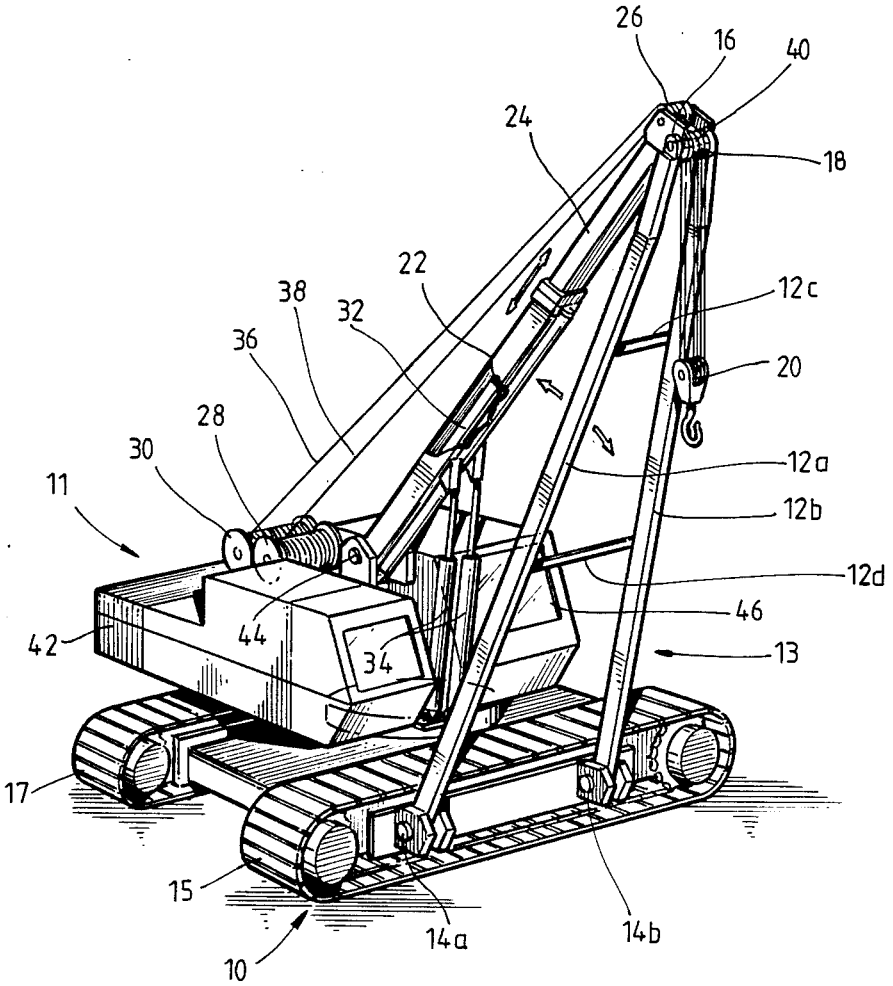

In the drawing, identified as FIG. 1, the two-boom crawler crane of the invention 10 is made up generally of an A-frame boom 13 having converging arms 12*a* and 12*b* held together at the top by a pin 16 and pin holder 18 and cross pieces connecting said arms and joined along the length of track 15 to the side of the frame of crawler crane 10 by pin-plate arrangements 14*a* and 14*b;* main body or cab portion 11, which includes a part thereof 46 behind A-frame boom 13; a variable-length boom 44, preferably telescoping, having sections 22 and 24 and cut away at 22 to show hydraulic means 32, representative of one way of moving it in and out; tracks 15 and 17; a winch 28 with cable (used herein as including wire rope) 38 for operating hook block 20 via sheaves 40; if desired, an auxiliary winch 30 with cable 36 and sheaves 26 for moving variable-length boom 44 in and out; boom lift cylinders 34; and, preferably, one or more counterweights as may be needed to compensate for the presence of A-frame boom 13.

From the foregoing description, it may readily be seen that the present invention permits three ways to raise and lower the variable-length boom. When lift cylinders only are used, the length of the boom may be floated. Hydraulic means such as those 32 shown inside the variable-length boom may be employed to power it in and out. Also, auxiliary winch 30—cable 38 means may be used.

While the invention has been described in terms of preferred embodiments, the claims appended hereto are intended to encompass all embodiments which fall within the spirit of the invention.

Having thus described my invention and certain preferred embodiments thereof, I claim:

1. A crawler crane comprising, joined together in a lifting and moving capacity:

(1) a crane frame;

(2) tracks positioned in a travellable manner on both sides of said frame;

(3) a main body mounted on said frame in a rotatable manner;

(4) a telescoping boom projecting from said main body;

(5) a fixed-length A-frame boom with two arms thereof at lower ends thereof joined to one side of said frame along the length of one of said tracks and projecting upward therefrom, said arms of said A-frame boom being pinned together at upper ends thereof and affixed in a rotatable manner where they are pinned together at upper ends thereof to the upper end of said telescoping boom in a supporting manner;

(6) a load winch having at least one cable extending over said telescoping boom providing support for said A-frame boom;

(7) means for lifting said telescoping boom and (8) means for extending said telescoping boom.

2. The crawler crane of claim 1 wherein said means for lifting said telescoping boom comprise at least one lift cylinder extending underneath said telescoping boom from said main body of said crawler crane to a point along the underside of said telescoping boom and said means for extending said telescoping boom comprise hydraulic power means inside it.

3. The crawler crane of claim 1 wherein said crawler crane has an auxiliary winch to move said telescoping boom in and out.

4. The crawler crane of claim 1 wherein said A-frame boom has at least one cross member connecting said arms of said A-frame boom.

5. The crawler crane of claim 1 wherein said A-frame boom has two cross members connecting said arms of said A-frame boom.

* * * * *